US012595990B1

(12) United States Patent
Goertz et al.

(10) Patent No.: US 12,595,990 B1
(45) Date of Patent: Apr. 7, 2026

(54) MAIN CHARGE HOLDER FOR ELECTRO-EXPLOSIVE DEVICES (EEDS)

(71) Applicant: Raytheon Company, Arlington, VA (US)

(72) Inventors: Eric D. Goertz, Whitewater, CO (US); Montgomery Carlo, Sahuarita, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/957,381

(22) Filed: Nov. 22, 2024

(51) Int. Cl.
*F42B 3/12* (2006.01)
*F42D 1/045* (2006.01)

(52) U.S. Cl.
CPC ..... *F42B 3/125* (2013.01); *F42D 1/045* (2013.01)

(58) Field of Classification Search
CPC .... F42B 3/12; F42B 3/11; F42B 3/107; F42B 3/103; F42B 3/127; F42B 3/13
USPC ... 102/200, 202.7, 202, 202.5, 202.1, 202.4, 102/202.9, 202.8, 202.11, 202.12, 202.14, 102/202.2
See application file for complete search history.

(56) References Cited

U.S. PATENT DOCUMENTS

| | | | |
|---|---|---|---|
| 3,362,329 | A | 1/1968 | Sidney |
| 4,788,913 | A | 12/1988 | Stroud et al. |
| 6,105,503 | A | 8/2000 | Baginski |
| 6,752,083 | B1 | 6/2004 | Lerche et al. |
| 7,574,960 | B1 | 8/2009 | Dockery et al. |
| 8,091,477 | B2 | 1/2012 | Brooks et al. |
| 8,281,718 | B2 | 10/2012 | Rice |
| 8,291,824 | B1 | 10/2012 | Welle et al. |
| 9,534,875 | B2 | 1/2017 | Neyer et al. |
| 10,816,310 | B2 | 10/2020 | Tirmizi et al. |
| 11,060,827 | B1 | 7/2021 | Krueger |

FOREIGN PATENT DOCUMENTS

| | | | |
|---|---|---|---|
| CA | 2497099 | C | 5/2015 |

OTHER PUBLICATIONS

Scholtes, J.H.G., et al., "Development of Exploding Foil Initiators for Future IM", Retrieved Online. URL: < https://publications.tno.nl/publication/34610638/pfC1RD/2007-BU3-EM-Proc-101-4.pdf>, 9 pgs.

*Primary Examiner* — Reginald S Tillman, Jr.
(74) *Attorney, Agent, or Firm* — Schwegman Lundberg & Woessner, P.A.

(57) ABSTRACT

The header of an EED is redesigned to increase stiction forces to better hold the main charge throughout deflagration. The header includes a main charge holder, integrally formed or as a discrete component, that has internal structure that is press fit to a complementary outer surface of the main charge. The contact area between the internal structure and the main charge being greater than the contact area between a cylinder that circumscribes the internal structure (the uniform cylindrical shape of a typical EED contact area of π*D*L) to increase stiction forces between the main charge holder and the main charge. For a given diameter and length, the inclusion of the internal structure will reduce the mass of the main charge.

20 Claims, 8 Drawing Sheets

MAIN CHARGE HOLDER FOR ELECTRO-EXPLOSIVE DEVICES (EEDS)

BACKGROUND

Field

This disclosure relates to electro-explosive devices (EEDs) that convert an electrical stimulus into heat, which initiates the deflagration of a pyrotechnic or propellant main charge.

Description of the Related Art

An electro-explosive device (EED) converts an electrical stimulus into heat, which initiates the deflagration of a pyrotechnic charge.

As shown in FIGS. 1A and 1B, a typical EED 100 includes a cylindrical header 102 having an external thread 104 and an internal cylindrical cavity 106. The header 102 is typically metal such as stainless steel. The EED 100 threads into a device such as a pressure vessel or rocket motor igniter.

To construct EED 100, a glass preform 108 is inserted into a portion of internal cylindrical cavity 106 to receive pins or wires 110 and fused. A bridgewire 112 is connected between pins 110. An insulating ignition charge holder 114 is bonded in place around the bridgewire 112. A sensitive ignition charge 116 is loaded and pressed into the insulating ignition charge holder 114. The sensitive ignition charge 116 is not allowed to contact the metal header 102 for ESD protection. An insulating powder 118 is suitably pressed over the open end of the sensitive ignition charge 116 to provide further ESD protection. A pyrotechnic or propellant main charge 120 is loaded into the into the internal uniform cylindrical cavity 106 and pressed. A main charge holder 122, conductive or insulating, may or may not be positioned between main charge 120 and header 102. The main charge 120 is less sensitive and thus not susceptible to ESD events. If included, the main charge holder 122 has a uniform cylindrical shape to match the header's internal cylindrical cavity 106. A closure disk 124 is welded over the open end of the main charge 120.

To ignite EED 100, an electrical stimulus is applied to pins 110, which heats bridgewire 112. This in turn ignites the sensitive ignition charge 116 causing a burn front to propagate rapidly forward (e.g. a few hundred micro seconds) and through insulating powder 118 to ignite main charge 120 causing it to deflagrate and a burn front to propagate forward (e.g., 1 to 30 milliseconds) to consume the pyrotechnic/propellant main charge.

The EED 100 is designed and spec'd for the entire mass of the pyrotechnic charge 120 to remain and deflagrate within header 102 within the short time window. However, the dynamics of the burn fronts of the ignition charge and pyrotechnic charge are such that high pressure is produced that the closure disk 124 may rupture prematurely and allow portions of pyrotechnic charge 120 to be expelled from the header prior to or while the charge is burning. This negatively impacts the deflagration performance of the EED.

Referring now to FIG. 2, a lot of identically designed and constructed EEDs were tested in a pressure vessel. A high percentage of the devices performed as designed and provided high peak pressures 200 in the burn window. However, a certain percentage of the devices, those in which some amount of pyrotechnic charge material was expelled from the header, failed to perform as designed and provided much lower peak pressures 202. The problem is that a failed EED cannot be detected until it is fired. This is an undesirable failure mode.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an EED in which the header is designed to increase stiction forces to better retain the main charge throughout deflagration and improve performance uniformity for devices throughout a lot.

In an embodiment, the header includes a main charge holder, integrally formed or as a discrete component, that has internal structure that is press fit to a complementary outer surface of the main charge. The contact area between the internal structure and the main charge being greater than the contact area $\pi*D*L$ between a cylinder that circumscribes the internal structure to increase stiction forces between the main charge holder and the main charge to enhance retention of the main charge for a given diameter D and length L during deflagration.

In an embodiment, the header includes an external thread around a cylindrical outer surface. The external thread facilitates operation coupling to a system such as a pressure driven actuator or rocket ignitor.

In different embodiments, the main charge may be one-piece or segmented into multiple pieces.

In an embodiment, the contiguous piece is an N-pointed star in which the N points of the star lie on the circumscribed circle, where N is an integer of at least 3.

In an embodiment, the contiguous piece includes N evenly-spaced spokes that extend radially from a point on the circumscribed circle through the center of the circle to another point on the circumscribed circle opposite the point, wherein N is at least 2

In an embodiment, the contiguous piece includes N evenly-spaced spokes that extend radially from a point on the circumscribed circle towards the center of the circle but stopping short of the circle, wherein N is at least 4.

In an embodiment, the internal structure includes N evenly-spaced spokes that extend radially from a point on the circumscribed circle through the center of the circle to another point on the circumscribed circle opposite the point, wherein N is at least 2.

In an embodiment, the internal structure includes N evenly-spaced spokes that extend radially from a point on the circumscribed circle towards the center of the circle but stopping short of the circle, wherein N is at least 4, wherein the internal structure further includes an inner ring center about the center of the circle and supported by the N evenly-spaced spokes.

In different embodiments, the internal structure may extend the full length L of the main charge or may terminate before the open end of the EED.

In different embodiments, the contact area is increased by at least 5% or at least 50% as compared to the circumscribing circle $\pi*D*L$.

In an embodiment, the contact area is increased by at least 50% and the mass of the main charge is reduced by less than 20%.

In different embodiments, the main charge may be a pyrotechnic or propellant.

In different embodiments, the main charge holder may be formed from a conductive or insulating material.

These and other features and advantages of the disclosure will be apparent to those skilled in the art from the following detailed description of preferred embodiments, taken together with the accompanying drawings, in which:

DETAILED DESCRIPTION

Figure 1B:
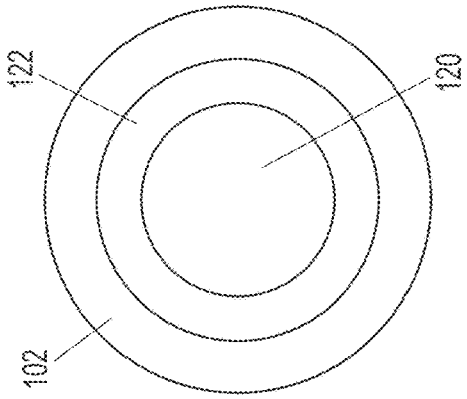
FIG. 1B (PRIOR ART)
FIGS. 1A-1B, as described above, are section views of a typical electro-explosive device (EED)
Figure 1A:
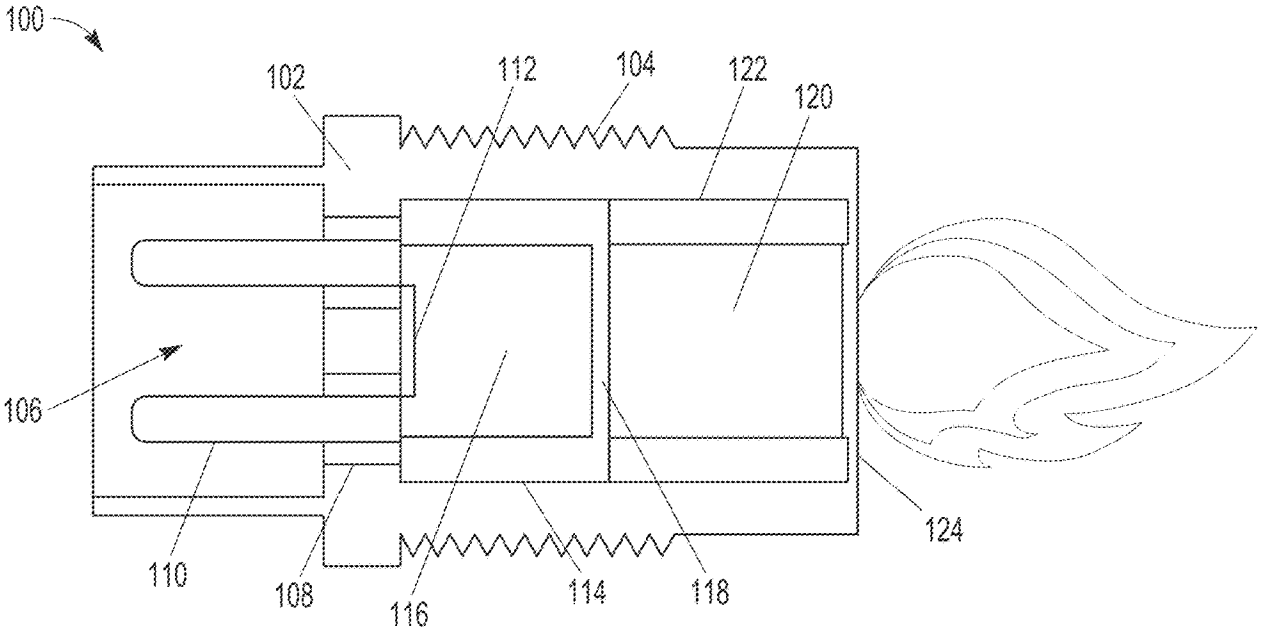
FIG. 1A (PRIOR ART)
Figure 2:
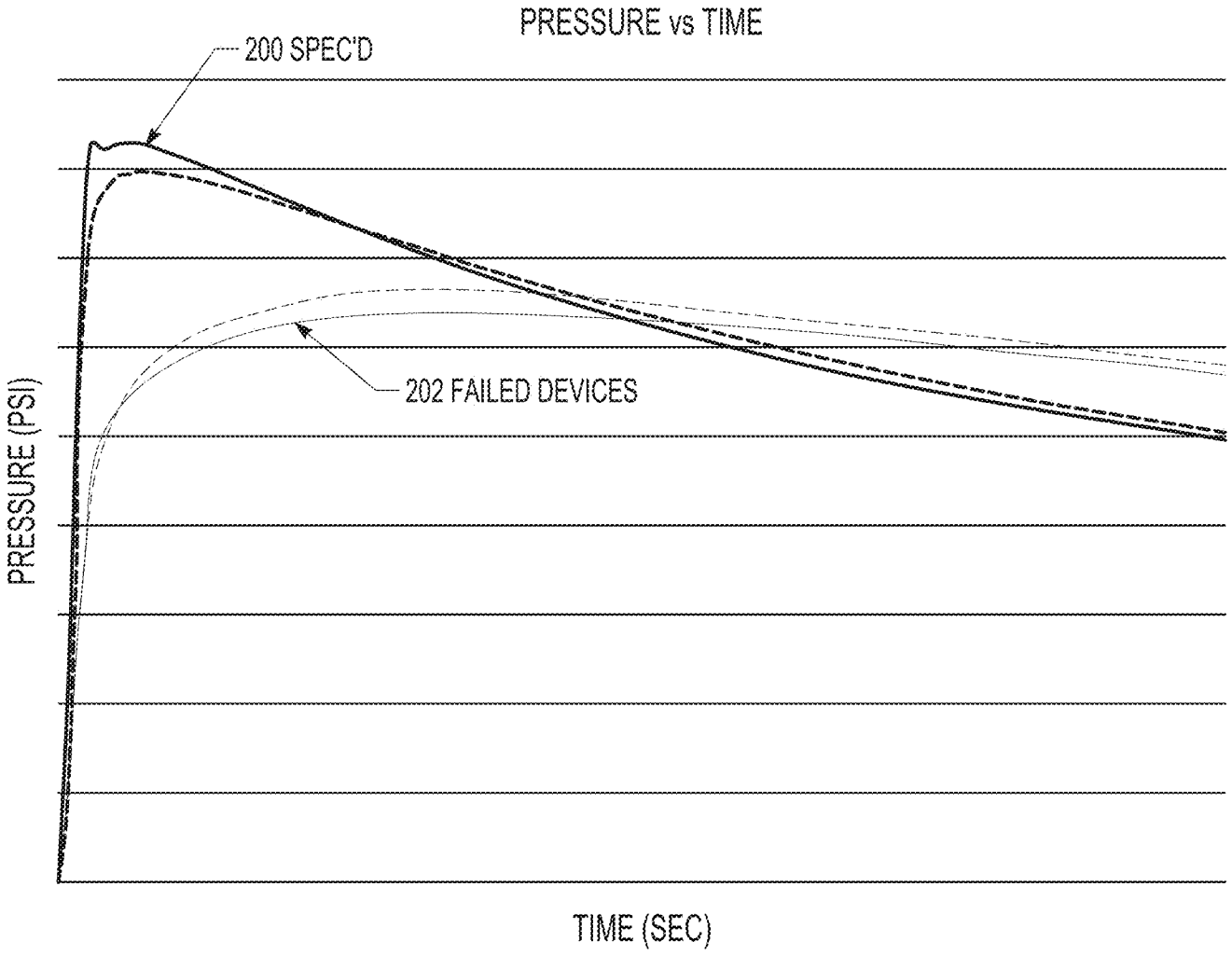
FIG. 2 (PRIOR ART)
FIG. 2, as described above, is a plot of pressure vs time for a sample of identically designed and identically constructed EEDs fired in a pressure vessel.

In the typical EED, the main charge is retained in the header via stiction forces between the main charge and the main charge holder. The uniform cylindrical shape common to all EEDs produces stiction forces that are proportion to the surface area of the cylinder i.e. $\pi$*D*L where D is the diameter and L is the length of the cylinder. A uniform cylindrical shape is easy and inexpensive to fabricate, facilitates ease of loading and compaction of the main charge and exhibits known burn dynamics. However, as shown in FIG. 2, a certain percentage of EEDs selected from the same lot can lose main charge material when fired and fail to produce specified pressure levels during deflagration. This is an onerous problem because a failed EED cannot be detected until it is fired.

The present disclosure provides an EED in which the header is designed to increase stiction forces to better hold the main charge throughout deflagration. The header includes a main charge holder, integrally formed or as a discrete component, that has internal structure that is press fit to a complementary outer surface of the main charge. The contact area between the internal structure and the main charge being greater than the contact area between a cylinder that circumscribes the internal structure (the uniform cylindrical shape of a typical EED contact area of $\pi$*D*L) to increase stiction forces between the main charge holder and the main charge. For a given diameter and length, the inclusion of the internal structure will reduce the mass of the main charge. How much the contact area is increased and how much the mass of the main charge is decreased will depend on the particular design of the internal structure and the application for the EED. The mass of the main charge may be restored by either increasing the diameter or length of the header. The case and expense to fabricate, case of loading and compaction of the main charge and burn dynamics of the EED may be affected by the internal structure.

Figure 3:
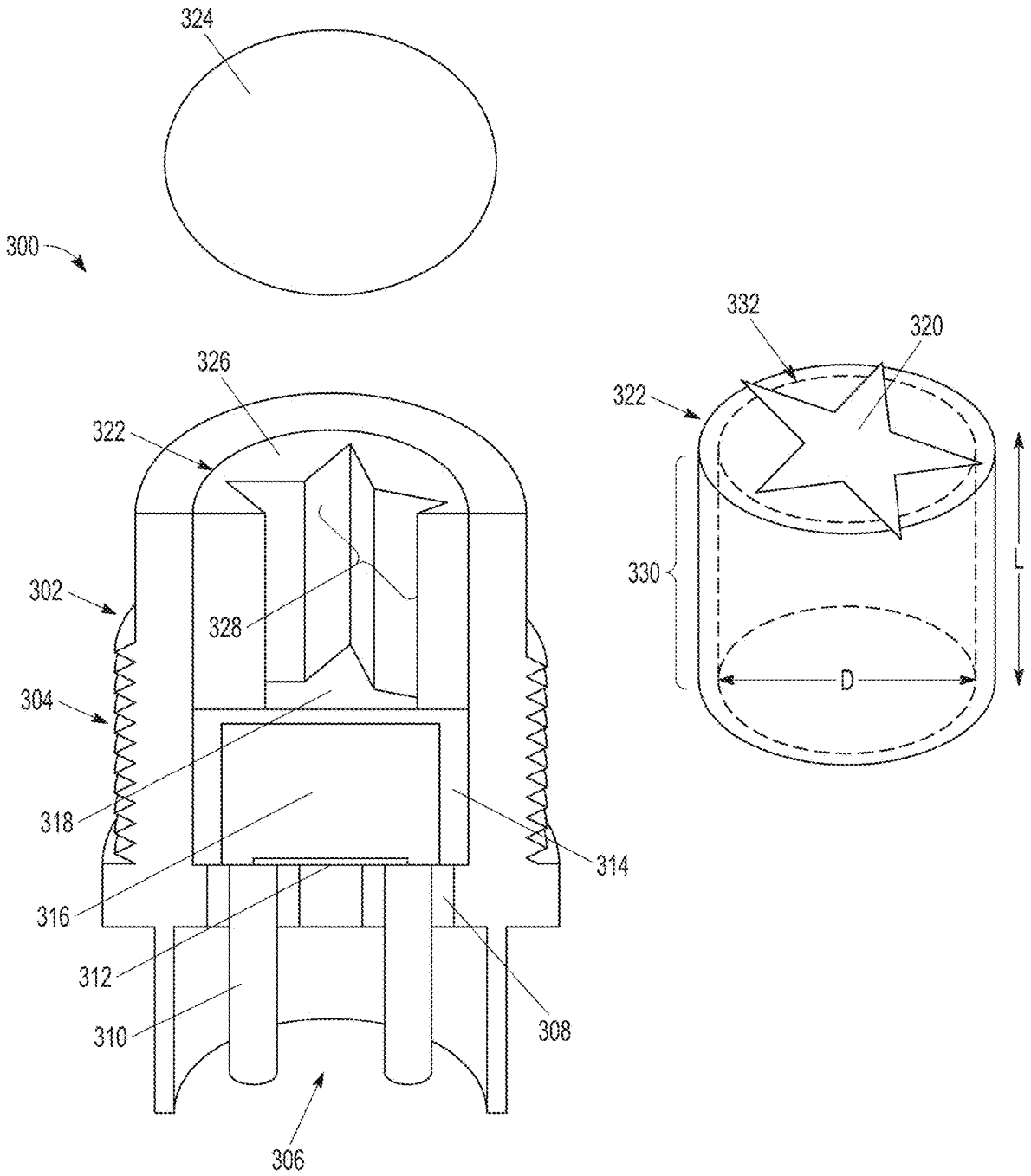
FIG. 3 is a view of an EED configured with internal structure to hold the main charge.

As shown in FIG. 3, an embodiment of an EED 300 a cylindrical header 302 having an external thread 304 and an internal cylindrical cavity 306. The header 302 is typically metal such as stainless steel. The EED 300 threads into a device such as a pressure vessel or rocket motor igniter.

A glass preform 308 is positioned in a portion of internal cylindrical cavity 308 to receive pins or wires 310 and fused. A bridgewire 312 is connected between pins 310. An insulating ignition charge holder 314 is bonded in place around the bridgewire 312. A sensitive ignition charge 316 is loaded and pressed into the insulating ignition charge holder 314. The sensitive ignition charge 316 is not allowed to contact the metal header 302 for ESD protection. An insulating powder 318 is suitably pressed over the open end of the sensitive ignition charge 316 to provide further ESD protection.

A main charge holder 322, conductive or insulating is positioned in the internal cylindrical cavity 308. Main charge holder 322 is shown here as a separate piece but could be integrally formed with header 302. A pyrotechnic or propellant main charge 320 is loaded into the into the main charge holder 322 and pressed. The main charge 320 is less sensitive and thus not susceptible to ESD events. A closure disk 324 is welded over the open end of the main charge 120.

Main charge holder 322 includes internal structure 326 that increases a contact area 328 between the main charge holder 322 and main charge 320 and thus increases the stiction forces between the main charge holder 322 and main charge 320. The contact area 328 between the internal structure and the main charge being greater than a contact area 330 between a cylinder 332 that circumscribes the internal structure 326 (having contact area of $\pi$*D*L). Main charge 320 will now have a shape that is not uniformly circular or uniformly cylindrical along the length of the header. For a given diameter D and length L, the inclusion of the internal structure 326 will reduce the mass of the main charge 320. In this example, internal structure 326 extends along the entire length L. In other configurations, the internal structure may be recessed from closure disk 324. How much the contact area 328 is increased and how much the mass of the main charge is decreased will depend on the particular design of the internal structure 326 and the application for the EED 300.

In this example, the internal structure 326 that protrudes from circumscribing cylinder 332 toward the center of the header forms a 5-pointed star pattern in main charge 320. The path length around the 5-pointed star pattern is longer than the path length around circumscribing cylinder 332, hence the contact area 328 is increased relative to contact area 330.

To ignite EED 300, an electrical stimulus is applied to pins 310, which heats bridgewire 312. This in turn ignites the sensitive ignition charge 316 causing a burn front to propagate rapidly forward (e.g. a few hundred micro seconds) and through insulating powder 318 to ignite main charge 320 causing it to deflagrate and a burn front to propagate forward (e.g., 1 to 30 milliseconds) to consume the pyrotechnic/propellant main charge.

The EED 300 is designed and spec'd for the entire mass of the pyrotechnic charge 320 to remain and deflagrate within header 302 within the short time window. However, the dynamics of the burn fronts of the ignition charge and pyrotechnic charge are such that high pressure is produced that the closure disk 324 may rupture prematurely and allow portions of pyrotechnic charge 320 to be expelled from the header prior to or while the charge is burning. This negatively impacts the deflagration performance of the EED.

Figure 4:
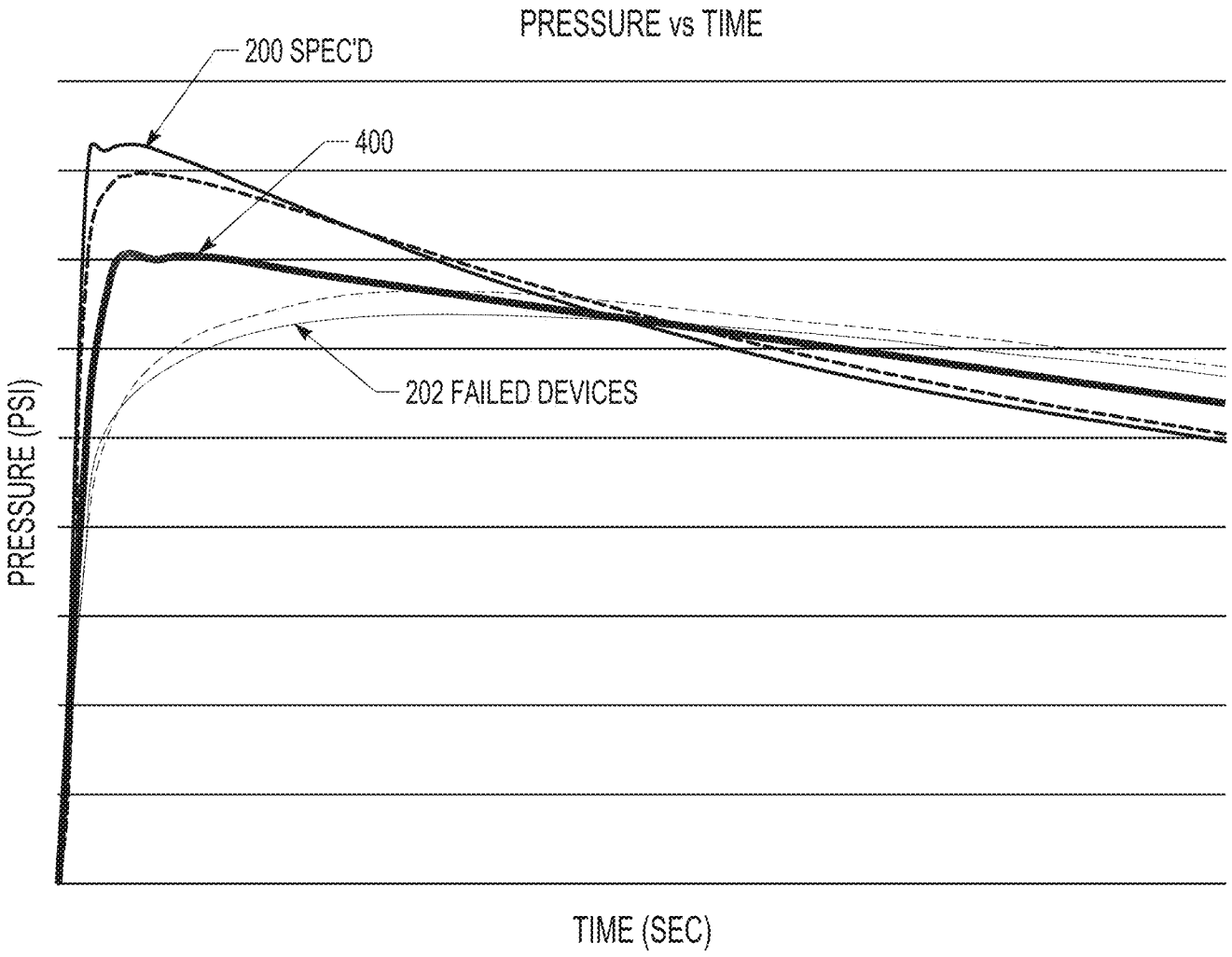
FIG. 4 is a plot of pressure vs time comparing the internally structured EED to the samples of the typical EEDs.

Referring now to FIG. 4, a lot of identically designed and constructed EEDs were tested in a pressure vessel. As previously described and shown in FIG. 2, high percentage of the devices performed as designed and provided high peak pressures 200 in the burn window. However, a certain percentage of the devices, those in which some amount of pyrotechnic charge material was expelled from the header, failed to perform as designed and provided much lower peak pressures 202. Again, the problem is that a failed EED cannot be detected until it is fired. This is an undesirable failure mode. A lot of identically designed and constructed EEDs provided with the main charge holder having internal structure provide somewhat lower peak pressures 400 (due to the reduced main charge mass for the same diameter D) but do so uniformly across all devices in the lot. The header's D and L can be changed to provide the requisite peak pressure 400 for a specific application. The elimination of the failure mode being key.

A particular design for the internal structure 326 will depend on many factors; what level of stiction forces is required, what peak pressure is required, case and cost of manufacturing, and burn rate dynamics of the EED. A few different examples for the internal structure 326 are depicted in FIGS. 5, 6, 7, 8A-8B and 9.

Figure 5:
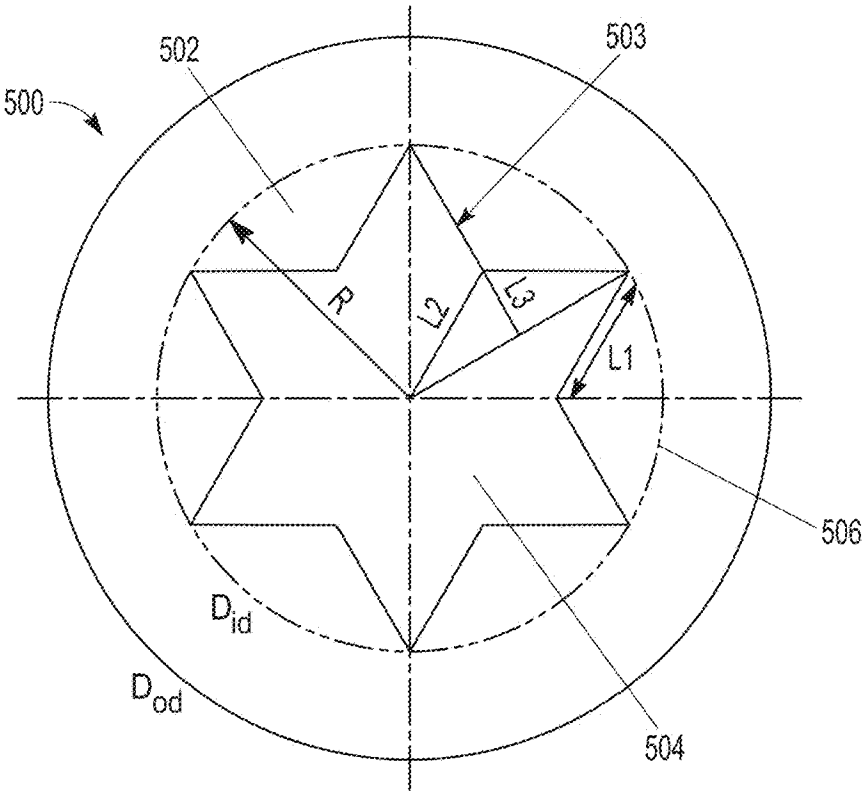
FIG. 5 is a section view of an embodiment of the internal structure of a main charge holder for the EED.

Referring now to FIG. 5, in an embodiment a main charge holder 500 includes internal structure 502 having pie-shaped segments that defines a 6-pointed star pattern 503 in a main charge 504. Main charge holder 500 has an outer diameter $D_{od}$ and an inner diameter $D_{id}$ that defines the circle 506 that circumscribes the internal structure 502 with the points 508 of the star lying on circle 506. Assuming a radius of 1.5 and L1=L2=0.86 and L3=0.43 (unitless), this structure increases the contact area by approximately 9.5% (assuming it runs the full length L) over the uniform cylindrical main charge holder. However, it results in a main charge mass reduction of approximately 45%.

Figure 6:
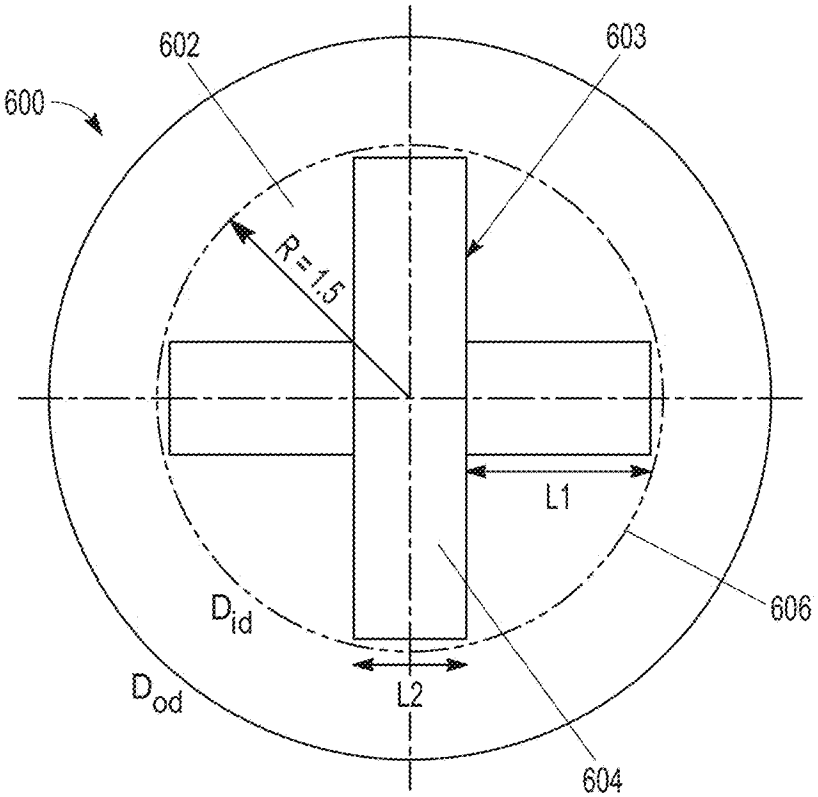
FIG. 6 is a section view of an embodiment of the internal structure of a main charge holder for the EED.

Referring now to FIG. 6, in an embodiment a main charge holder 600 includes internal structure 602 having pie-shaped segments that defines 2 spokes 603 in a main charge 604. Main charge holder 600 has an outer diameter $D_{od}$ and an inner diameter $D_{id}$ that defines the circle 606 that circumscribes the internal structure 602 with the ends 608 of each spoke lying on circle 606. Assuming a radius of 1.5 and L1=1.075 and L2=0.7 (unitless), this structure increases the contact area by approximately 21% (assuming it runs the full length L) over the uniform cylindrical main charge holder. However, it results in a main charge mass reduction of approximately 50%.

Figure 7:
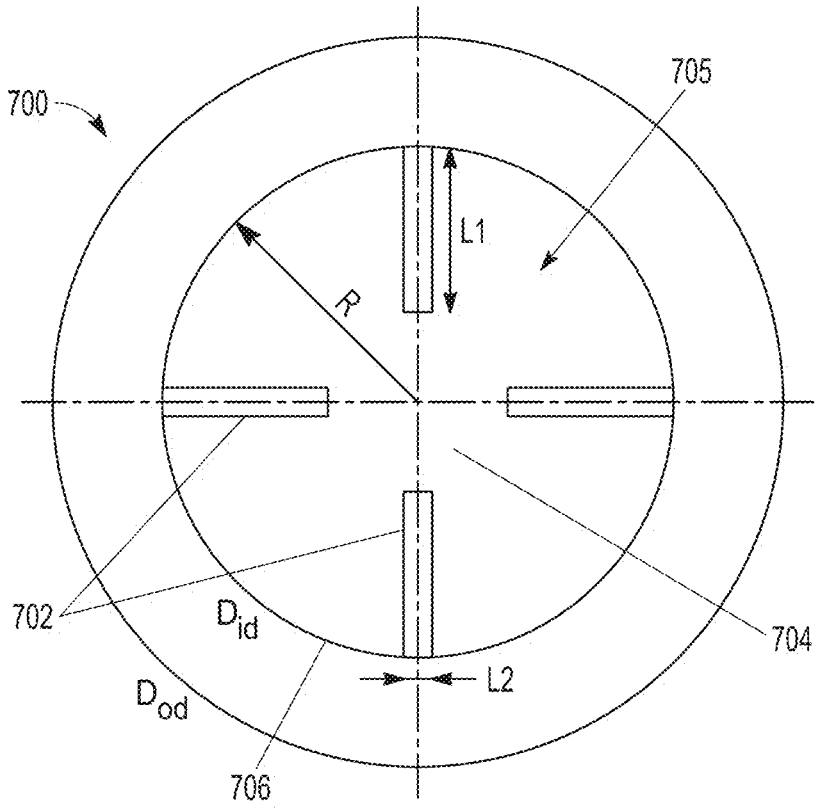
FIG. 7 is a section view of an embodiment of the internal structure of a main charge holder for the EED.

Referring now to FIG. 7, in an embodiment a main charge holder 700 includes internal structure 702 having 4 spokes that define truncated pie-shaped segments 705 in a main charge 704. Main charge holder 700 has an outer diameter $D_{od}$ and an inner diameter $D_{id}$ that defines the circle 706 that circumscribes the internal structure 702 with the ends 708 of each spoke lying on circle 706 and extending towards but stopping short of the center of the circle. Assuming a radius of 1.5 and L1=0.75 and L2=0.1 (unitless), this structure increases the contact area by approximately 64% (assuming it runs the full length L) over the uniform cylindrical main charge holder. This design results in a main charge mass reduction of only approximately 4%.

Figure 8B:
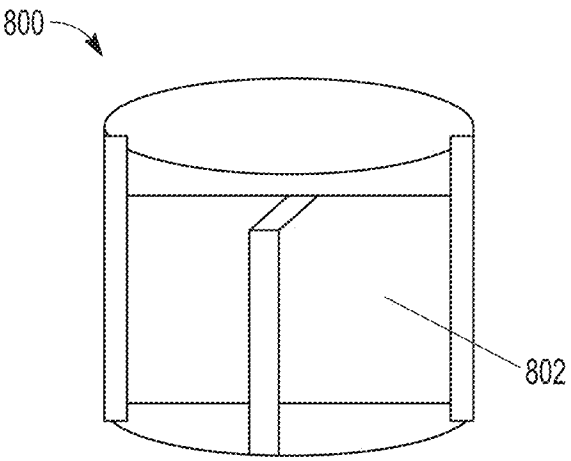
FIGS. 8A-8B are section and perspective views of an embodiment of the internal structure of a main charge holder for the EED.
Figure 8A:
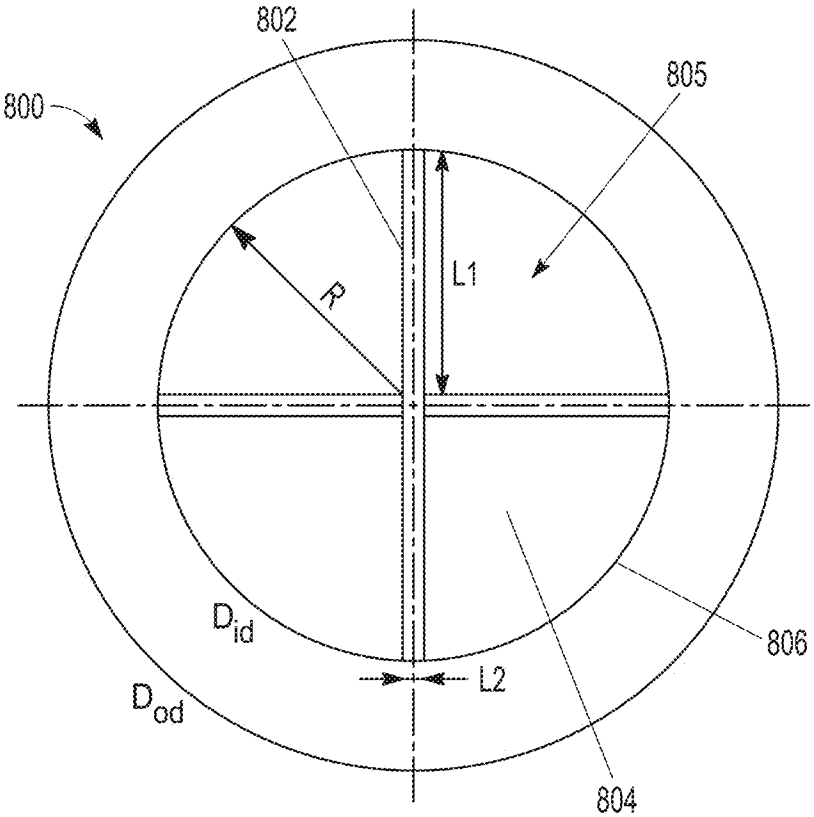

Referring now to FIGS. 8A-8B, in an embodiment a main charge holder 800 includes internal structure 802 having 2 spokes that define pie-shaped segments 805 in a main charge 804. Main charge holder 800 has an outer diameter $D_{od}$ and an inner diameter $D_{id}$ that defines the circle 806 that circumscribes the internal structure 802 with the ends 808 of each spoke lying on circle 806 and extending through the center of the circle to the opposite side of the circle. Assuming a radius of 1.5 and L1=3 and L2=0.1 (unitless), this structure increases the contact area by approximately 100% (assuming it runs the full length L) over the uniform cylindrical main charge holder. This design results in a main charge mass reduction of only approximately 8%. As shown in FIG. 8B, internal structure 802 may be recessed from a closure disk 808, in which case the increase in contact area and the reduce in main charge mass will be slightly reduced.

Figure 9:
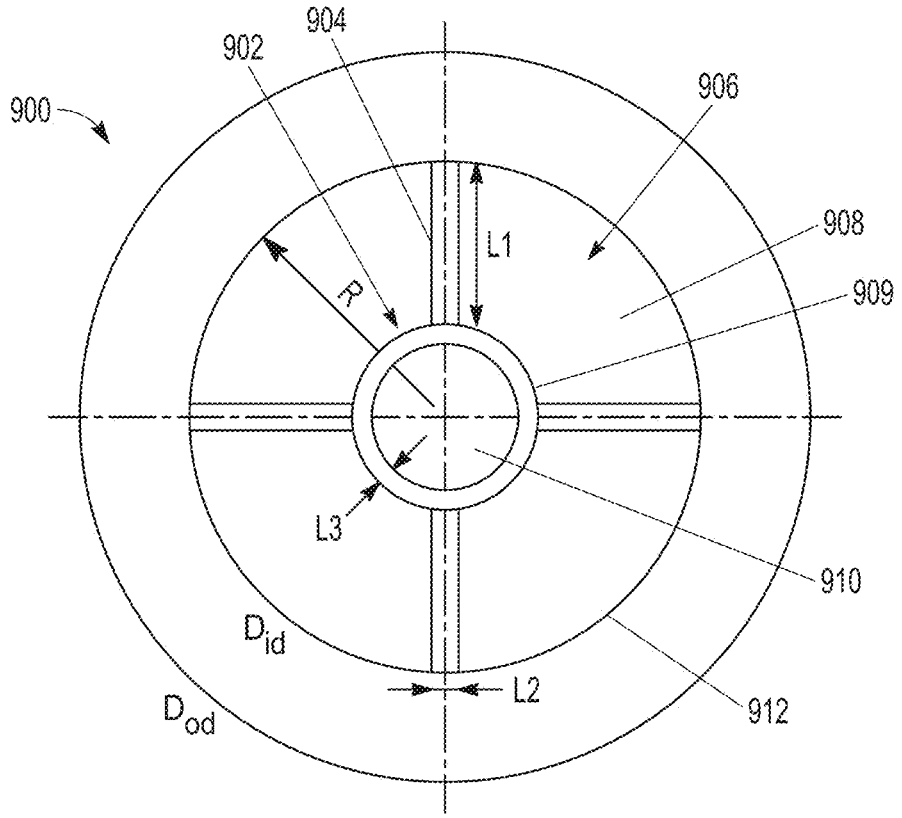
FIG. 9 is a section view of an embodiment of the internal structure of a main charge holder for the EED.

Referring now to FIG. 9, in an embodiment a main charge holder 900 includes internal structure 902 having 4 spokes 904 that define truncated pie-shaped segments 906 in a main charge 908 and an inner ring 909 about the center and supported by the 4 spokes 904 that defines a circular segment 910 in main charge 908. Main charge holder 900 has an outer diameter $D_{od}$ and an inner diameter $D_{id}$ that defines the circle 912 that circumscribes the internal structure 902 with the ends of each spoke 904 lying on circle 912 and extending towards but stopping short of the center of the circle. Assuming a radius of 1.5 and L1=0.75, L2=0.1 and L3=0.1 (unitless), this structure increases the contact area by approximately 141% (assuming it runs the full length L) over the uniform cylindrical main charge holder. This design results in a main charge mass reduction of only approximately 16%.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. An electro-explosive device (EED), comprising:

a metal header having a cylindrical cavity, said metal header having an external thread;

a plurality of wires extending through a preform at one end of the header;

at least one bridgewire operatively coupled to the plurality of wires at a closed end of the cylindrical cavity;

an insulating ignition charge holder positioned at the closed end of the cylindrical cavity;

an ignition charge loaded and compacted into the ignition charge holder;

a main charge holder positioned on top of the ignition charge holder;

a main charge loaded and compacted into the main charge holder; and a closure disk that seals the main charge within the header;

wherein the main charge holder includes an internal structure press fit to the main charge;

wherein the internal structure has a contact area with the main charge greater than π*D*L where D is the diameter of a circle than circumscribes the internal structure and L is the length of the main charge holder to increase stiction forces between the main charge holder and the main charge to enhance retention of the main charge during deflagration of the main charge.

2. The EED of claim 1, wherein the contact area is at least 5% greater than π*D*L.

3. The EED of claim 1, wherein the contact area is at least 50% greater than $\pi*D*L$.

4. The EED of claim 3, wherein the mass of the main charge is at most 20% less than the volume $\pi*D^2/4*L$.

5. The EED of claim 3, wherein the mass of the main charge is at most 10% less than the volume $\pi*D^2/4*L$.

6. The EED of claim 1, wherein the internal structure extends the entire length L of the main charge holder.

7. The EED of claim 1, wherein the internal structure stops short of the length L of the main charge holder so that the main charge is a contiguous piece opposite the closure disk.

8. The EED of claim 1, wherein the main charge is a contiguous piece.

9. The EED of claim 8, wherein the contiguous piece is an N-pointed star in which the N points of the star lie on the circumscribed circle, where N is an integer of at least 3.

10. The EED of claim 8, wherein the contiguous piece includes N evenly-spaced spokes that extend radially from a point on the circumscribed circle through the center of the circle to another point on the circumscribed circle opposite the point, wherein N is at least 2.

11. The EED of claim 8, wherein the contiguous piece includes N evenly-spaced spokes that extend radially from a point on the circumscribed circle towards the center of the circle but stopping short of the circle, wherein N is at least 4.

12. The EED of claim 1, wherein the main charge is segmented.

13. The EED of claim 12, wherein the internal structure includes N evenly-spaced spokes that extend radially from a point on the circumscribed circle through the center of the circle to another point on the circumscribed circle opposite the point, wherein N is at least 2.

14. The EED of claim 2, wherein the internal structure includes N evenly-spaced spokes that extend radially from a point on the circumscribed circle towards the center of the circle but stopping short of the circle, wherein N is at least 4, wherein the internal structure further includes an inner ring center about the center of the circle and supported by the N evenly-spaced spokes.

15. A main charge holder for use with an electro-explosive device (EED) having a metal header with a cylindrical cavity having a length L and a diameter D1, said main charge holder comprising:

a sleeve having a cylindrical outer diameter D1 and length L and a cylindrical inner diameter D2; and an internal structure integrally formed and supported on the cylindrical inner diameter D2 configured to accept a main charge;

wherein the internal structure has a contact area with the main charge greater than $\pi*D2*L$ to increase stiction forces between the main charge holder and the main charge to enhance retention of the main charge during deflagration of the main charge.

16. The EED of claim 15, wherein the contact area is at least 5% greater than $\pi*D2*L$.

17. The EED of claim 15, wherein the contact area is at least 50% greater than $\pi*D2*L$.

18. The EED of claim 17, wherein the mass of the main charge is at most 20% less than the volume $\pi*D2^2/4*L$.

19. The EED of claim 15, wherein the internal structure extends the entire length L of the main charge holder.

20. The EED of claim 15, wherein the internal structure stops short of the length L of the main charge holder so that the main charge is a contiguous piece opposite the closure disk.

* * * * *